US006105209A

United States Patent [19]

Brady

[11] Patent Number: 6,105,209

[45] Date of Patent: Aug. 22, 2000

[54] FABRIC CUTTING WEIGHT WITH INTEGRAL SPIKES

[76] Inventor: John R. Brady, 20041 Osterman Rd., No. R4, Lake Forest, Calif. 92630

[21] Appl. No.: 09/102,381

[22] Filed: Jun. 22, 1998

[51] Int. Cl.[7] ..... B43M 9/00

[52] U.S. Cl. ..... 16/403; D19/96

[58] Field of Search ..... 16/403, DIG. 8; 43/44.9, 9.1, 44.87, 43.14; D19/96, 97

[56] References Cited

U.S. PATENT DOCUMENTS

| | | | |
|---|---|---|---|
| 22,682 | 8/1859 | Dorsam | 16/403 |
| 165,465 | 7/1875 | Whitney | 16/403 |
| 417,375 | 12/1889 | Walker | 16/403 |
| 444,328 | 1/1891 | Boss . | |
| 533,980 | 2/1895 | Adams | 16/403 |
| 592,968 | 11/1897 | Gipe | 16/403 |
| 1,225,952 | 5/1917 | Hamilton . | |
| 1,277,211 | 8/1918 | Graham . | |
| 1,886,109 | 11/1932 | Lenfant | 16/403 |
| 2,284,518 | 5/1942 | Green | 273/148 |
| 2,814,274 | 11/1957 | Diamond | 120/82 |
| 2,814,275 | 11/1957 | Diamond | 120/82 |
| 3,405,476 | 10/1968 | Pumilio | 43/43.14 |
| 3,788,487 | 1/1974 | Dawson | 211/49 D |
| 3,813,727 | 6/1974 | Borer et al. | 16/1 |
| 3,818,727 | 6/1974 | Hadam et al. | 66/127 |
| 3,852,907 | 12/1974 | Haught | 43/43.14 |
| 4,040,199 | 8/1977 | Raptis | 43/43.14 |
| 5,253,790 | 10/1993 | Brady | 223/109 R |

FOREIGN PATENT DOCUMENTS

| | | | |
|---|---|---|---|
| 595357 | 1/1925 | France | 211/59.1 |

*Primary Examiner*—Chuck Y. Mah

*Attorney, Agent, or Firm*—Stetina Brunda Garred & Brucker

[57] ABSTRACT

In accordance with the present invention, there is provided a fabric cutting weight for holding a pattern and material to be cut in place upon a mat. The weight is provided with a first housing half. The weight is further provided with a second housing half formed to engage the first housing half. The housing halves are cooperatively formed to define a volume therebetween. The first housing half has integrally formed spikes protruding therefrom. The weight is further provided with a filler material disposed within the volume defined by the housing halves.

17 Claims, 1 Drawing Sheet

Fig. 1
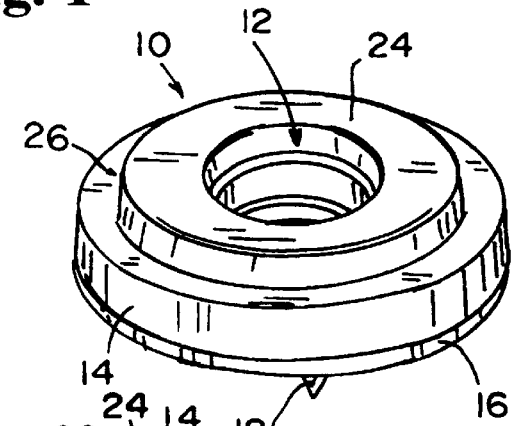
Fig. 2
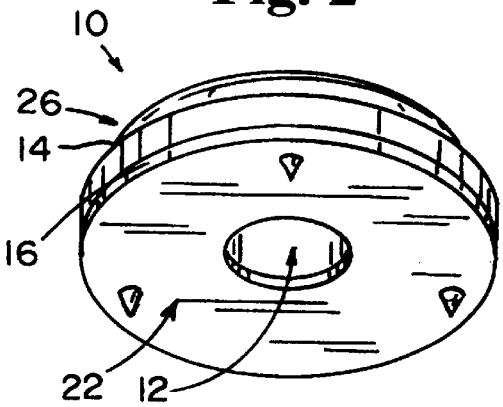
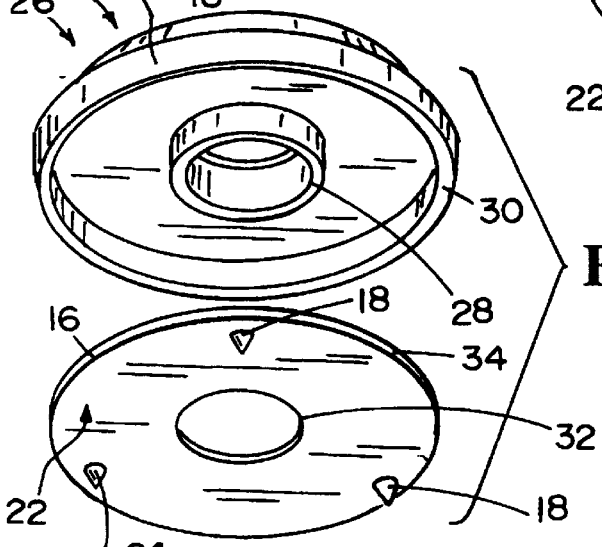
Fig. 3
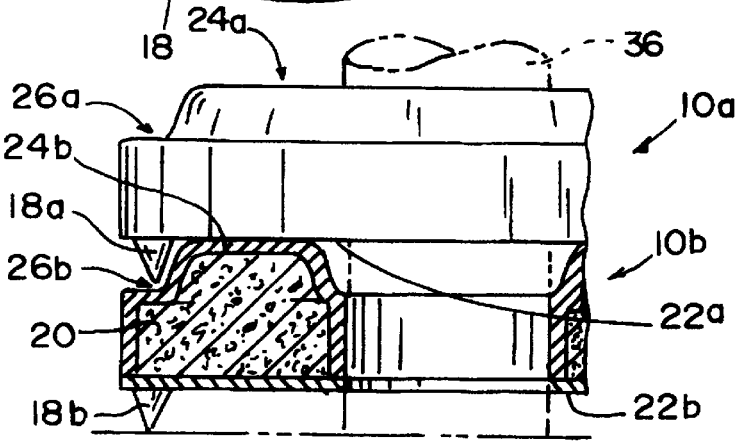
Fig. 4
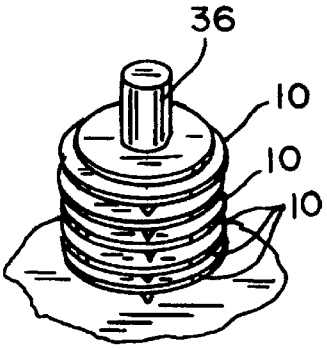
Fig. 5

FABRIC CUTTING WEIGHT WITH INTEGRAL SPIKES

FIELD OF THE INVENTION

The present invention relates generally to sewing, and more particularly to a weight having spikes for holding a pattern and material to be cut in place upon a mat such that the pattern does not move relative to the material to be cut during the cutting process.

BACKGROUND OF THE INVENTION

It is often desirable to cut material to be used in the fabrication of clothing, quilts, and various other fabric articles. A fabric cutting system is disclosed in U.S. Pat. No. 5,253,790 to Brady and the subject matter of such patent is incorporated herein by reference. As taught by Brady, fabric to be cut may be placed upon a mat which both facilitates the attachment of a pattern to the fabric to be cut and provides a protective surface for the table top upon which it is usually positioned. A pattern, which defines the shape to which the material is to be cut, is generally attached to the material via weights having sharp pins extending from the lower surface thereof, i.e., pin weights. Such pin weights are generally positioned at intervals about the pattern along the cut to be made such that the pins extend downwardly through the pattern, through the material to be cut. Thus, the pins of the pin weights prevent relative movement of the pattern and material to be cut, thereby preventing shifting during the cutting process. A rotary razor cutter may be used to cut the material in the shape of the pattern by pressing the cutter against the material to be cut.

As further disclosed in U.S. Pat. No. 5,253,790 to Brady the pin weights used each have a housing which must be drilled to facilitate the insertion of pins or thumbtacks through the bottom of the housing such that the pointed tips of the pins extend downwardly therethrough. A steel washer is inserted into the housing for providing the pin weight with sufficient mass to holding the fabric in place during the cutting process. Although generally suitable for its intended purpose, in light of the prior art fabric cutting weights, such as the above described pin weights, it is therefore evident that there exists a need in the art for an improved fabric cutting weight which is relatively easy to manufacture and assemble and is relatively low cost.

SUMMARY OF THE INVENTION

In accordance with the present invention, there is provided a fabric cutting weight for holding a pattern and material to be cut in place upon a mat. The weight is provided with a first housing half. The weight is further provided with a second housing half formed to engage the first housing half. The housing halves are cooperatively formed to define a volume therebetween. The first housing half has integrally formed spikes protruding therefrom. The weight is further provided with a filler material disposed within the volume defined by the housing halves.

In the preferred embodiment of the fabric cutting weight of the present invention, the housing halves are formed to define a generally annular volume. The second housing half has a bottom surface with the spikes protruding therefrom. The first housing half has an external surface which has at least one depression therein. The depression is sized and configured to receive without contacting the spikes of the external surface of the second housing half to facilitate stacking of the second housing half upon the first housing half. In addition, the filler material comprises metal tailings or other relatively dense material and the housing halves may be formed of plastic.

As such, based on the foregoing, the present invention mitigates the inefficiencies and limitations associated with prior art weights. Advantageously, the fabric cutting weight of the present invention incorporates spikes which are integrally formed into second housing half thereof. As one of ordinary skill in the art will appreciate, such integrally formed nature of the spikes avoids the need to perform additional machining of the second housing half and assembly associated therewith to insert separately formed spikes or pins through the bottommost portion of the second housing half. Thus, such a design lowers material and manufacturing costs relative to prior art designs. In addition, a filler material is used to filled the interior of the housing halves. Such filler material may take the form of metal tailings or sand, for example, and such materials are contemplated to be relatively low in cost. Furthermore, because the weight of the present invention is formed via a simple two half housing construction, assembly of the same is relatively simple. It is contemplated that the filler material may be scooped into the interior of the housing halves. Subsequently, the housings may be attached to each other with the filler material enclosed therein.

Accordingly, the present invention represents a significant advance in the art.

BRIEF DESCRIPTION OF THE DRAWINGS

These, as well as other features of the present invention, will become more apparent upon reference to the drawings wherein:

FIG. 1 depicts a top perspective view of the fabric cutting weight of the present invention;

FIG. 2 depicts a bottom perspective view ○ the fabric cutting weight of FIG. 1;

FIG. 3 depicts exploded view of the fabric cutting weight of FIG. 2;

FIG. 4 depicts a cross sectional view of the fabric cutting weight of the present invention as shown with another such weight stacked upon it; and FIG. 5 depicts a perspective view of multiple fabric cutting weights of the present invention which are stacked upon each other.

DETAILED DESCRIPTION OF THE PREFERRED EMBODIMENT

Referring now to the drawings wherein the showings are for purposes of illustrating a preferred embodiment of the present invention only, and not for purposes of limiting the same, FIGS. 1–5 illustrate a fabric cutting weight which is constructed in accordance with the present invention.

In accordance with the present invention, there is provided a fabric cutting weight 10 for holding a pattern and material to be cut in place upon a mat. The weight 10 is preferably generally circular in configuration and has a generally circular central opening 12 formed therein. The weight is preferably provided with generally annular first and second housing halves 14, 16. The housing halves 14, 16 are cooperatively formed to define a generally annular volume with the circular central opening 12 extending therethrough. In this respect the housing halves 14, 16 are formed to sealably engage one another. The second housing half 14 has integrally formed spikes 18 protruding therefrom. The weight 10 is further provided with a filler material

20 disposed within the generally annular volume defined by the housing halves 14, 16. It is contemplated that weight 10 may have configurations other than annular, such as triangular, circular, geometric and others known to one of ordinary skill in the art. In this respect, the weight 10 is not required to have a central opening 12. The advantages of such an opening 12, however, are discussed below.

In the preferred embodiment of the fabric cutting weight 10 of the present invention, the second housing half 16 has an external surface 22 with the spikes 18 protruding therefrom. The second housing half 16 may be of a generally disc or washer shape as best seen in FIG. 3. The first housing half 14 has an external surface 24 which has at least one depression 26 therein. The depression 26 is sized and configured to receive without contacting the spikes 18 of the external surface 22 of the second housing half 16 to facilitate stacking of the second housing half 16 upon the first housing half 14. Referring now to FIG. 4, a fabric cutting weight 10*a* is stacked upon another similarly formed weight 10*b* (shown in cross-section). As can be seen, the external surface 22*a* of the second housing half 16*a* is supported by the external surface 24*b* of the first housing half 14*b*. The annular depression 26*a* in the external surface 22*a* accommodates the spikes 18*b* without contact. Thus, an annular void is formed between the external surface 22*b* of the second housing half 16*b* and the external surface 24*a* of the first housing half 14*a*. Such non-contact is contemplated to facilitate stacking of the weights 10 without dulling of the tips of the spikes 18 by repeated contact with other weights 10.

As mentioned above, the fabric cutting weight 10 of the present invention may be provided with a circular central opening 12. In this regard, the first housing half 14 is generally defined by an inner diameter 28 as well as an outer diameter 30. Likewise, the second housing half 16 is generally defined by an inner diameter 32 as well as an outer diameter 34. As such, the inner diameters 28, 32 of the housing halves 14, 16 are cooperatively sized and configured to sealably engage each other. Likewise, the outer diameters 30, 34 are cooperatively sized and configured to sealably engage each other. The engagement of the respective inner and outer diameters 28, 30, 32, 34 of the housing halves 14, 16 creates the formation of generally annular volume disposed within between. It is contemplated that the inner diameters 28, 32 are chosen to define the circular central opening 12 of the fabric cutting weight 10 so as to facilitate stacked storage of the weight 10 about a post 36, as depicted in FIGS. 4 and 5. The fabric cutting weight 10 may be formed of a variety of sizes and weights such that the user is provided with some flexibility of use. The circular central opening 12, and therefore the inner diameters 28, 32, may optionally have a variety of sized to facilitate segregation thereof. Thus, the weights 10 of a given size and weight may be stacked upon a particular sized diameter post 36.

In the preferred embodiment of the present invention, the housing halves 14, 16 are formed of injection molded or vacuum drawn plastic. As such, it is contemplated the such parts are advantageously low in cost to manufacture. In addition, the housing halves 14, 16 may be attached to one another any number of methods including adhesive bonding, sonic welding, optical bonding and other which are well known to one of ordinary skill in the art. In this respect it is contemplated that such attachment facilitates relatively easy assembly of the fabric cutting weight 10.

Preferably, the filler material 20 comprises metal tailings, sand or other relatively dense material which may be of a relatively inexpensive material. As such, the filler material 20 may be relatively low in cost, and yet capable of maximizing the occupancy of the volume defined enclosure within the housing halves 14, 16 due to its preferred particulate or granular nature.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A fabric cutting weight for holding a pattern and material to be cut in place upon a mat, the weight comprising:

a first housing half having an external surface having at least one depression therein;

a second housing half formed to engage the first housing half wherein the housing halves being cooperatively formed to define a volume therebetween, the second housing half having an external surface having integrally formed spikes protruding therefrom;

a filler material disposed within the volume defined by the housing halves; and wherein the at least one depression of the external surface of the first housing half being sized and configured to receive but without contacting the spikes of the external surface of a second housing half to facilitate stacking of the latter second housing half upon the first housing half.

2. The fabric cutting weight of claim 1 wherein the volume being circular.

3. The fabric cutting weight of claim 1 wherein the volume being triangular.

4. The fabric cutting weight of claim 1 wherein the volume being annular.

5. The fabric cutting weight of claim 4 wherein the first housing half has an outer diameter and the at least one depression is an annular depression disposed adjacent the outer diameter.

6. The fabric cutting weight of claim 4 wherein the first housing half has inner and outer diameters and the second housing half is formed to engage the inner and outer diameters to define an annular volume between the housing halves.

7. The fabric cutting weight of claim 4 wherein the second housing half is an annular disc.

8. The fabric cutting weight of claim 1 wherein the housing halves are formed of a plastic.

9. The fabric cutting weight of claim 8 wherein the polymer material is injection molded plastic.

10. The fabric cutting weight of claim 8 wherein the polymer material is vacuum formed plastic.

11. The fabric cutting weight of claim 1 wherein the housing halves have respective inner diameters which are cooperatively sized and configured to receive a post therethrough.

12. The fabric cutting weight of claim 1 wherein the spikes comprise at least three spikes.

13. The fabric cutting weight of claim 1 wherein the filler material comprises metal tailings.

14. The fabric cutting weight of claim 1 wherein the filler material comprises sand.

15. The fabric cutting weight of claim 1 wherein the housing halves are sonically welded to each other.

16. The fabric cutting weight of claim 1 wherein the housing halves are adhesively bonded to each other.

17. The fabric cutting weight of claim 1 wherein the housing halves are optically bonded to each other.

* * * * *